US006129179A

United States Patent [19]

Rooney et al.

[11] Patent Number: 6,129,179

[45] Date of Patent: Oct. 10, 2000

[54] LATERALLY EXTENSIBLE LADDER

[76] Inventors: William V. Rooney; Julie M. Rooney, both of 2202 NW. 10th St., Ankeny, Iowa 50021

[21] Appl. No.: 09/393,500

[22] Filed: Sep. 10, 1999

[51] Int. Cl.[7] ..... E06C 1/10

[52] U.S. Cl. ..... 182/156; 182/194; 182/195

[58] Field of Search ..... 182/151, 92, 228.1, 182/194, 195, 156, 159, 160; 248/200.1, 188.5, 256

[56] References Cited

U.S. PATENT DOCUMENTS

| | | | |
|---|---|---|---|
| 368,426 | 8/1887 | Ruttmann | 248/188.5 |
| 1,978,111 | 10/1934 | Klinzmann | 248/256 |
| 2,771,261 | 11/1956 | Niggelol | 248/188.5 |
| 2,924,414 | 2/1960 | Tesdal | 248/188.5 |
| 3,103,375 | 9/1963 | McMullin | 248/188.5 |
| 3,692,143 | 9/1972 | Kummerlin et al. . | |
| 3,978,944 | 9/1976 | Hickman et al. . | |
| 4,016,954 | 4/1977 | Hickman . | |
| 4,082,162 | 4/1978 | Diez | 182/228.1 |
| 4,132,288 | 1/1979 | Bingham . | |
| 4,907,675 | 3/1990 | Saby | 187/120 |
| 5,042,766 | 8/1991 | Baker | 248/200.1 |
| 5,201,488 | 4/1993 | Hadbauny | 248/200.1 |
| 5,495,915 | 3/1996 | Weston et al. . | |
| 5,645,140 | 7/1997 | Mouneimneh . | |
| 5,738,186 | 4/1998 | Jones . | |
| 5,960,905 | 10/1999 | Gardner | 182/129 |

FOREIGN PATENT DOCUMENTS

| | | | |
|---|---|---|---|
| 120151 | 7/1901 | Germany | 248/188.5 |

*Primary Examiner*—Alvin Chin-Shue
*Attorney, Agent, or Firm*—Dale J. Ream

[57] ABSTRACT

A laterally extensible ladder comprises first and second uprights having a plurality of adjacent rung assemblies mounted therebetween. Each rung assembly includes a first hollow rung element that defines a rung axis and a second rung element received in the first rung element. The second rung element is movable along the rung axis for adjusting the length of the rung assembly, hence adjusting the width of the ladder. At least one rung assembly includes a structure for releasably holding the rung assemblies at a selected width configuration.

3 Claims, 5 Drawing Sheets

LATERALLY EXTENSIBLE LADDER

BACKGROUND OF THE INVENTION

This invention relates to a ladder which is laterally extensible to provide greater side to side area upon which one or more persons may stand during use.

Ladders having two or more sections coupled for vertical extension are common for use by painters, carpenters, roofers, utility workers, and the like for providing access to elevations too high for access by a single ladder. Extension ladders having telescopic or foldable legs that are adapted for compact storage are also known such as those disclosed in U.S. Pat. Nos. 5,738,186 and 5,645,140. In addition, scaffolds are typically used when side to side movement at a fixed elevation is required. However, the known devices do not provide a singular device for providing convenient access to both vertical and lateral locations without repositioning the device.

Therefore, it is desirable to have a ladder which is laterally extensible to facilitate side to side movement by at least one user along the rungs of the ladder. It is further desirable to have a ladder which can be securely held at a desired width configuration.

SUMMARY OF THE INVENTION

Accordingly, the preferred embodiment of the present invention utilizes a ladder having conventional first and second uprights with a plurality of length-adjustable rung assemblies mounted adjacent one another therebetween. Each rung assembly includes a first section having a first rung element extending from the first stile and a second rung element telescopically received in the first rung element. Each rung assembly also includes a second rung section having a third rung element extending from the second stile and a fourth rung element telescopically received in the third rung element. The first and second rung sections define a rung axis and the second and fourth rung elements are telescopically movable therealong for adjusting the length of the rung assembly and, hence, the width of the ladder. A fifth rung element couples the second and fourth rung elements together. The top and bottom rung assemblies of the ladder include locking means for holding the ladder in a desired width configuration and for releasing the respective rung elements when adjustment is desired.

It is therefore a general object of this invention to provide a ladder that is laterally extensible.

Another object of this invention is to provide a ladder, as aforesaid, having telescopic rungs.

Still another object of this invention is to provide a ladder, as aforesaid, which can hold at least two adjacent persons on a single rung when fully extended.

A further object of this invention is to provide a ladder, as aforesaid, which can securely maintain a selectable width configuration until released for adjustment by a user.

A still further object of this invention is to provide a ladder, as aforesaid, which is easy to position and adjust.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
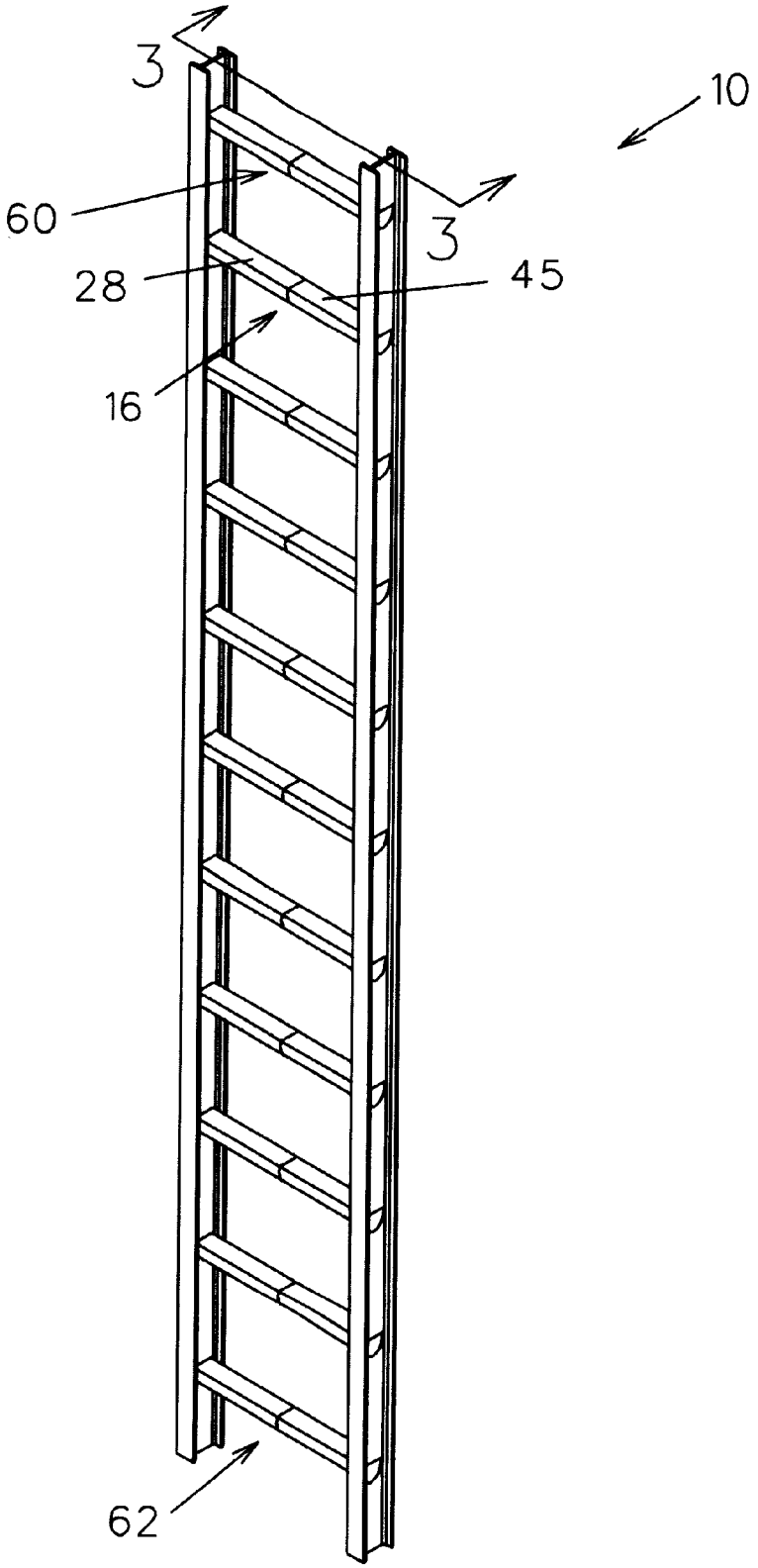
FIG. 1 is a perspective view of the preferred embodiment of the present invention.
Figure 2A:
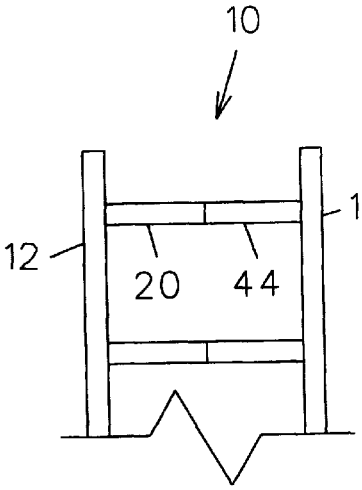
FIG. 2A is a fragmentary view on an enlarged scale showing a top section and a bottom section of the ladder of FIG. 1 in a retracted position.
Figure 2A:
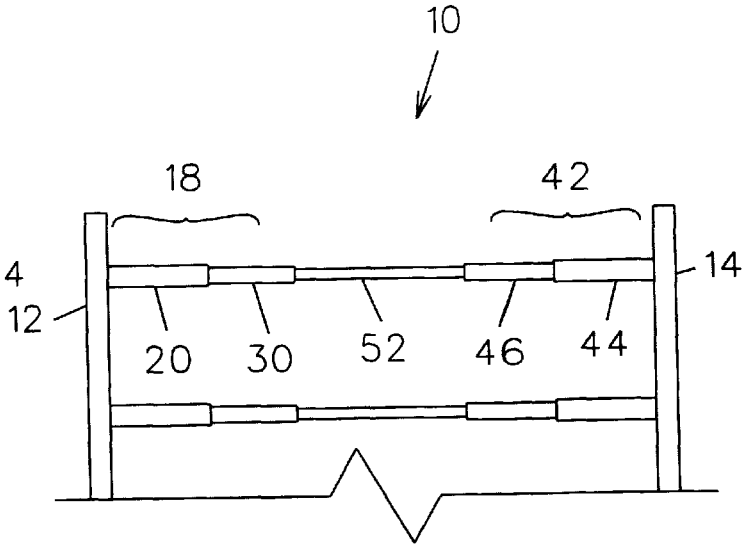
Figure 2A:
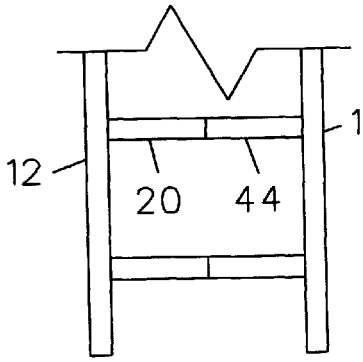
Figure 2B:
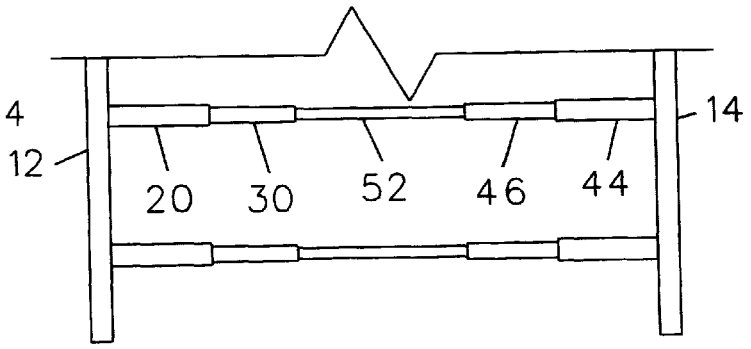
FIG. 2B is a fragmentary view on an enlarged scale showing a top section and bottom section of the ladder of FIG. 1 in an extended configuration.
Figure 3:
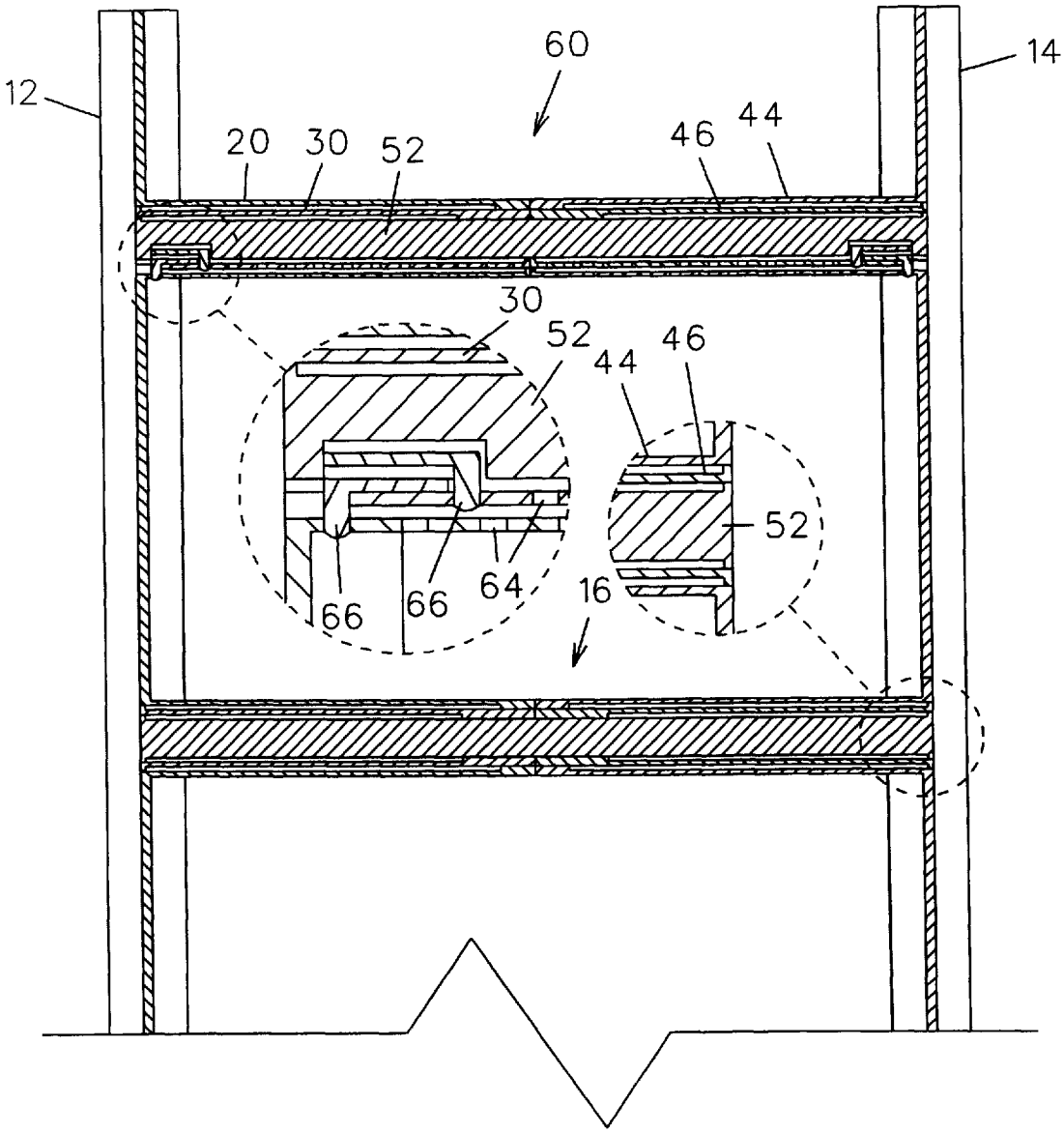
FIG. 3 is a sectional view of a top section of the ladder in a fully retracted configuration taken along line 3—3 of FIG. 1 with enlarged views of the locking mechanism of the top rung assembly and the construction of a second rung assembly.
Figure 4:
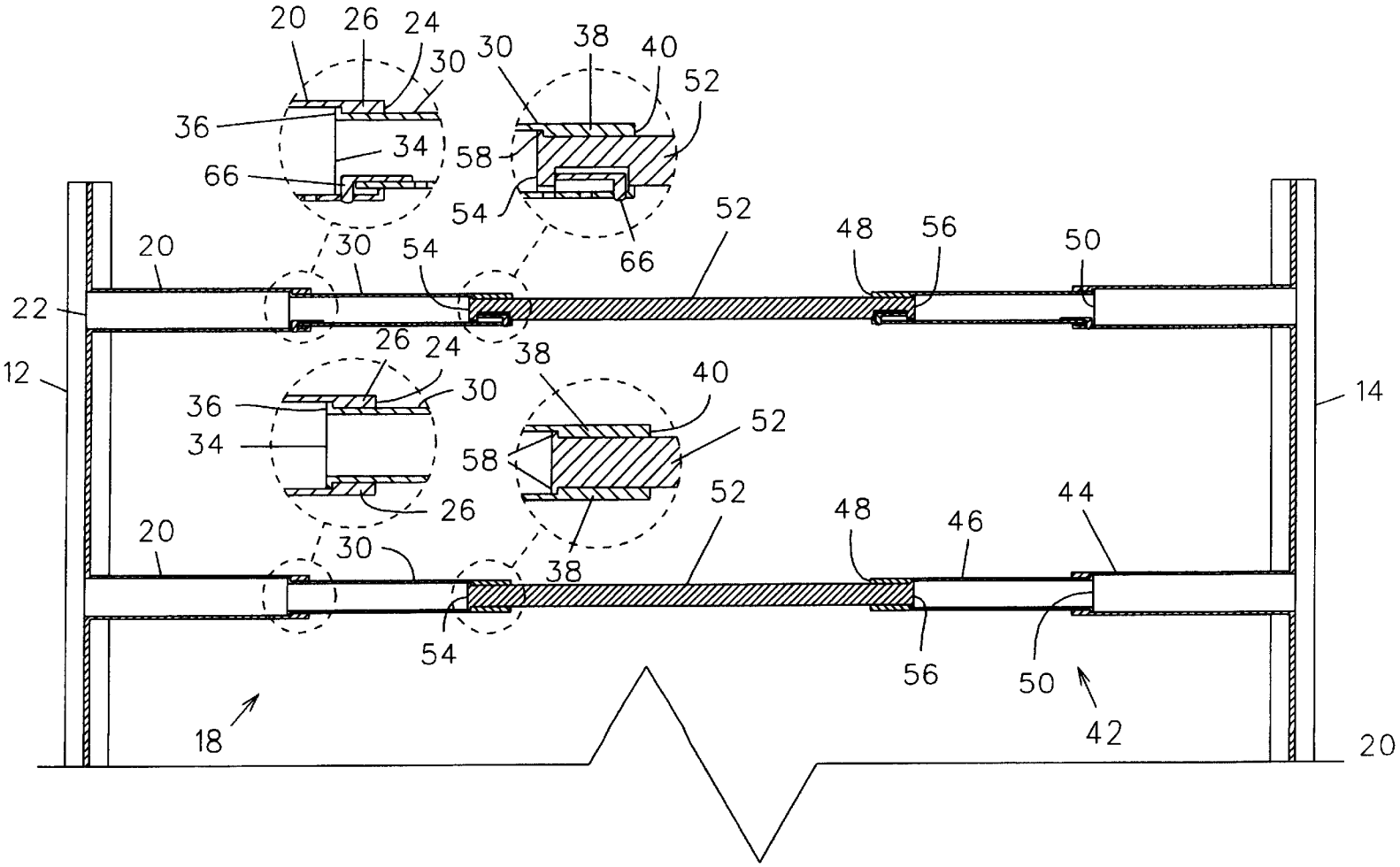
FIG. 4 is sectional view as in FIG. 3 with the rung assemblies in a fully extended configuration.

A laterally extensible ladder according to the preferred embodiment of the present invention is shown in FIG. 1. The ladder is preferably constructed of aluminum although the use of carbon fiber, fiberglass, or any metal that is structurally strong is also suitable. The ladder 10 includes first 12 and second 14 parallel stiles or uprights constructed in a conventional manner. A plurality of rung assemblies 16 are mounted adjacent one another between interior sides of the stiles 12, 14.

As shown in FIGS. 2A through 4, each of the rung assemblies 16 includes a first section 18 and a second section 42 which define a horizontal rung axis. The first section 18 includes a first rung element 20 normal to the first stile 12 and fixedly attached at one end 22 to the interior side thereof. The first rung element 20 is hollow and includes a second open end 24 displaced from the first stile 12. A ridge 26 extends about the interior surface of the second open end 24. The first rung element 20 presents a generally cylindrical configuration with a planar top side 28 (FIG. 1). The first section 18 further includes a second rung element 30 having a configuration complementary to the first rung element 20 and is slidably received therein. The second rung element 30 also includes a planar top side 32 which cooperates with the planar top side 28 of the first rung element 20 to prevent rotation of the second rung element 30 within the first rung element 20. A flange 36 extending about an end 34 of the second rung element 30 cooperates with the ridge 26 about the first rung element 20 to preclude the second rung element from being removed from the first rung element 20 upon full extension.

The second section 42 of each rung assembly 16 is constructed in substantially the same manner as the first section 18. Accordingly, a third rung element 44 is fixedly attached to the second stile 14. The third rung element 44 has a hollow configuration for receiving a fourth rung element 46 therein. The second 30 and fourth 46 rung elements are also hollow and include ridges 38 extending interiorly about open free ends 40, 48 thereof. Third 44 and fourth 46 rung elements also have planar top sides 45, 47 which cooperate to preclude rotation of the fourth rung element 46. Opposing ends 54, 56 of a fifth rung element 52 extend through the open free ends 40, 48 of the second 30 and fourth 46 rung elements, respectively and are held therein by flanges 58. The fifth rung element 52 also presents a generally cylindrical configuration with a planar top side which prevents rotation of the fifth rung element 52 within the second 30 and fourth 46 rung elements.

Figure 5:
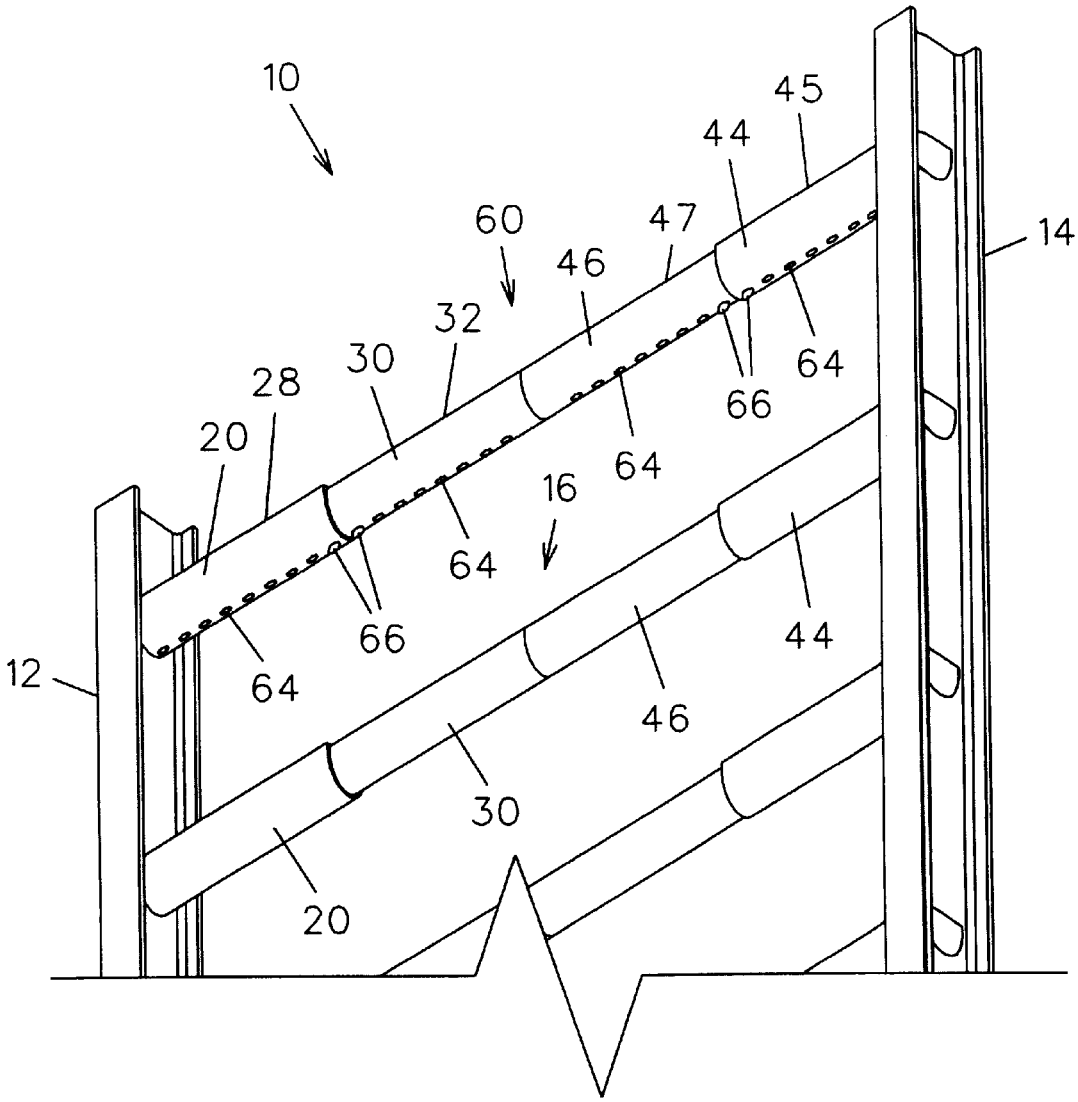
FIG. 5 is a fragmentary bottom perspective view of the ladder as in FIG. 1.

The top 60 and bottom 62 rung assemblies are substantially similar to the other rung assemblies 16 except as specifically noted below. As shown in FIG. 5, a plurality of apertures 64 extend through the bottom side of the first 20, second 30, third 44, and fourth 46 rung elements. Spring steel flanges 66, or other similar fasteners, are attached to the ends 34, 54 of the second 30 and fifth 52 rung elements which extend first into the first 20 and second 30 rung elements, respectively, for selectably engaging one of the apertures 64 and holding the rung assembly at a selected width. In like manner, spring steel flanges 66 are attached to the ends 50, 56 of the fourth 46 and fifth 52 rung elements which extend first into the third 44 and fourth 46 rung elements.

In use, the ladder 10 may be utilized in a conventional manner when the rung assemblies 16 are in a fully retracted position (FIG. 1). When a wider ladder is needed, preferably two users cooperate to increasingly displace the second stile 14 from the first stile 12. As the stiles 12, 14 are separated, the rung elements slidably move along the rung axis in telescopic extension. Also, a user moves his fingers along the apertures 64 in the rung elements to prevent a flange 66 from engaging an aperture 64 until the ladder is adjusted to the desired width. The flanges are then allowed to engage corresponding apertures 64 to hold the rung elements in place. The ladder 10 is placed in a retracted position by depressing the flanges 66 which are engaged in the apertures 64 and moving the stiles 12, 14 toward one another.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A laterally extensible ladder, comprising:

first and second stiles;

a plurality of length-adjustable rung assemblies mounted adjacent one another between said first and second stiles, each said rung assembly defining a rung longitudinal axis and comprising:

a first rung section having a first rung element attached to said first stile and a second rung element telescopically received in said first rung element and movable along said longitudinal axis for selectively adjusting the length of said first rung section;

a second rung section having a third rung element attached to said second stile and a fourth rung element telescopically received in said third rung element and movable along said longitudinal axis for adjusting the length of said second rung section;

a fifth rung element having first and second ends, said first end of said fifth rung element received in said second rung element of said first rung section and said second end of said fifth rung element received in said fourth rung element of said second rung section and movable along said rung longitudinal axis:

said first rung element defining a plurality of spaced apart apertures and said second rung element having a resilient flange coupled thereto and extending longitudinally along an interior surface thereof for selectable engagement with one of said apertures in said first rung element;

said third rung element defining a plurality of apertures and said fourth rung element having a resilient flange coupled thereto and extending longitudinally along an interior surface thereof for selectable engagement with one of said apertures in said third rung element;

said second rung element defining a plurality of apertures and said first end of said fifth rung element having a resilient flange coupled thereto and extending longitudinally along an interior surface thereof for selectable engagement with one of said apertures in said second rung element, whereby said first end of said fifth rung element may be completely received in said second rung element without contacting said flange of said second rung element: and said fourth rung element defining a plurality of apertures and said second end of said fifth rung element having a resilient flange coupled thereto and extending longitudinally along an interior surface thereof for selectable engagement with one of said apertures in said fourth rung element, whereby said second end of said fifth rung element may be completely received in said fourth rung element without contacting said flange of said fourth rung element said first, second, third, and fourth rung elements being of a hollow construction and the fifth rung element being of a solid construction, said fifth rung element having a length at least equal to the combined lengths of the first and third rung elements, whereby in a collapsed position of the ladder said second, fourth, and fifth rung elements are completely received in said first and third rung elements thereby providing solid rung assemblies, said second, fourth, and fifth rung elements having stop means at their ends to preclude removal from respective open ends of the first, second, third, and fourth rung elements.

2. A ladder as in claim 1 wherein said flanges of said fifth rung element being vertically displaced from said flanges of said second and fourth rung elements such that said fifth rung element may be completely received in said second and fourth rung elements without bearing against said flanges of said second and fourth rung elements.

3. A ladder as in claim 1, wherein each of said rung elements having a planar top side, wherein said planar top sides communicate to preclude relative rotation of the rung elements with respect to each other.

* * * * *